US007458180B2

(12) United States Patent
Liang

(10) Patent No.: US 7,458,180 B2
(45) Date of Patent: Dec. 2, 2008

(54) OPTICAL SIGHT HAVING A GLOW-IN-THE-DARK AIM INDICATOR

(75) Inventor: Shang-Yung Liang, Tan-Tzu Hsiang (TW)

(73) Assignee: Asia Optical Co., Inc., Taichung (TW)

( * ) Notice: Subject to any disclaimer, the term of this patent is extended or adjusted under 35 U.S.C. 154(b) by 331 days.

(21) Appl. No.: 11/405,529

(22) Filed: Apr. 18, 2006

(65) Prior Publication Data

US 2006/0288627 A1 Dec. 28, 2006

(30) Foreign Application Priority Data

Jun. 23, 2005 (TW) ..... 94120957 A

(51) Int. Cl.
*F41G 1/38* (2006.01)

(52) U.S. Cl. ..... 42/123; 42/132; 42/122

(58) Field of Classification Search ..... 42/123; 356/247; 33/265; 362/110, 383; 359/421–432
See application file for complete search history.

(56) References Cited

U.S. PATENT DOCUMENTS

| | | | | |
|---|---|---|---|---|
| 3,948,587 | A * | 4/1976 | Rubbert | 356/21 |
| 4,070,763 | A * | 1/1978 | Carts, Jr. | 42/132 |
| 5,724,761 | A * | 3/1998 | Bergacker | 42/123 |
| 6,721,095 | B2 * | 4/2004 | Huber | 359/427 |
| 6,729,062 | B2 * | 5/2004 | Thomas et al. | 42/122 |
| 2003/0097760 | A1 * | 5/2003 | Slates | 33/265 |
| 2005/0252065 | A1 * | 11/2005 | Scherpf | 42/123 |
| 2008/0043322 | A1 * | 2/2008 | Sauter et al. | 359/363 |

* cited by examiner

*Primary Examiner*—Michael Carone
*Assistant Examiner*—Samir Abdosh
(74) *Attorney, Agent, or Firm*—Banner & Witcoff, Ltd.

(57) ABSTRACT

An optical sight includes: an outer barrel having first and second ends; an objective lens unit mounted to the first end of the outer barrel; an ocular lens unit mounted to the second end of the outer barrel; and an aiming unit disposed in the outer barrel between the objective lens unit and the ocular lens unit. The aiming unit includes a glow-in-the-dark aim indicator that is self-illuminating.

13 Claims, 10 Drawing Sheets

OPTICAL SIGHT HAVING A GLOW-IN-THE-DARK AIM INDICATOR

CROSS-REFERENCE TO RELATED APPLICATION

This application claims priority of Taiwanese Application No. 094120957, filed on Jun. 23, 2005.

BACKGROUND OF THE INVENTION

1. Field of the Invention

The present invention relates to an optical sight, more particularly to an optical sight having a glow-in-the-dark aim indicator.

2. Description of the Related Art

FIGS. 1 and 2 show a conventional optical sight for use with a firearm. The optical sight includes an outer barrel 1 having first and second ends, an objective lens unit 2 mounted to the first end of the outer barrel 1, an ocular lens unit 3 mounted to the second end of the outer barrel 1, a magnification unit 4 used for magnification adjustment, a pair of adjustment units 5 used for elevation and windage adjustment, and an aiming unit 6.

The aiming unit 6 includes a plate member 61 mounted to a rear end of an inner barrel 401 of the magnification unit 4, and a lighting unit 62. The plate member 61 includes a reticle 611 used during aiming. The lighting unit 62 includes a securing seat 621 mounted to a rear end portion of the outer barrel 1, a potentiometer 622 disposed in the securing seat 621, a circuit board 623 also disposed in the securing seat 621, a battery holder 624 mounted to the securing seat 621, a battery 625 disposed in the battery holder 624, an adjusting ring 626 sleeved on the battery holder 624, a seal cover 627 sealingly mounted to the battery holder 624, are fraction ring 628 mounted in the outer barrel 1 and disposed to the rear of the plate member 61, and a light emitting diode (LED) 629 mounted on the refraction ring 628.

When using the optical sight in a low-light environment (e.g., at night), the LED 629 may be activated by rotating the adjusting ring 626. Therefore, the light of the LED 629 is directed onto the reticle 611 of the plate member 61, at least partly through refraction by the refraction ring 628. Hence, the user is able to make use of the optical sight even in a dark environment.

However, the presence of the lighting unit 62, which is complicated in structure, increases the overall costs and assembly time of the optical sight. Furthermore, the watertight and airtight capabilities of the outer barrel 1 may be compromised if the lighting unit 62 is not precisely manufactured.

SUMMARY OF THE INVENTION

Therefore, the object of the present invention is to provide an optical sight having a glow-in-the-dark aim indicator, thereby allowing for use of the optical sight in a low-light environment while maintaining the watertight and airtight capabilities of the optical sight.

The optical sight of this invention comprises: an outer barrel having first and second ends; an objective lens unit mounted to the first end of the outer barrel; an ocular lens unit mounted to the second end of the outer barrel; and an aiming unit disposed in the outer barrel between the objective lens unit and the ocular lens unit. The aiming unit includes a glow-in-the-dark aim indicator that is self-illuminating.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
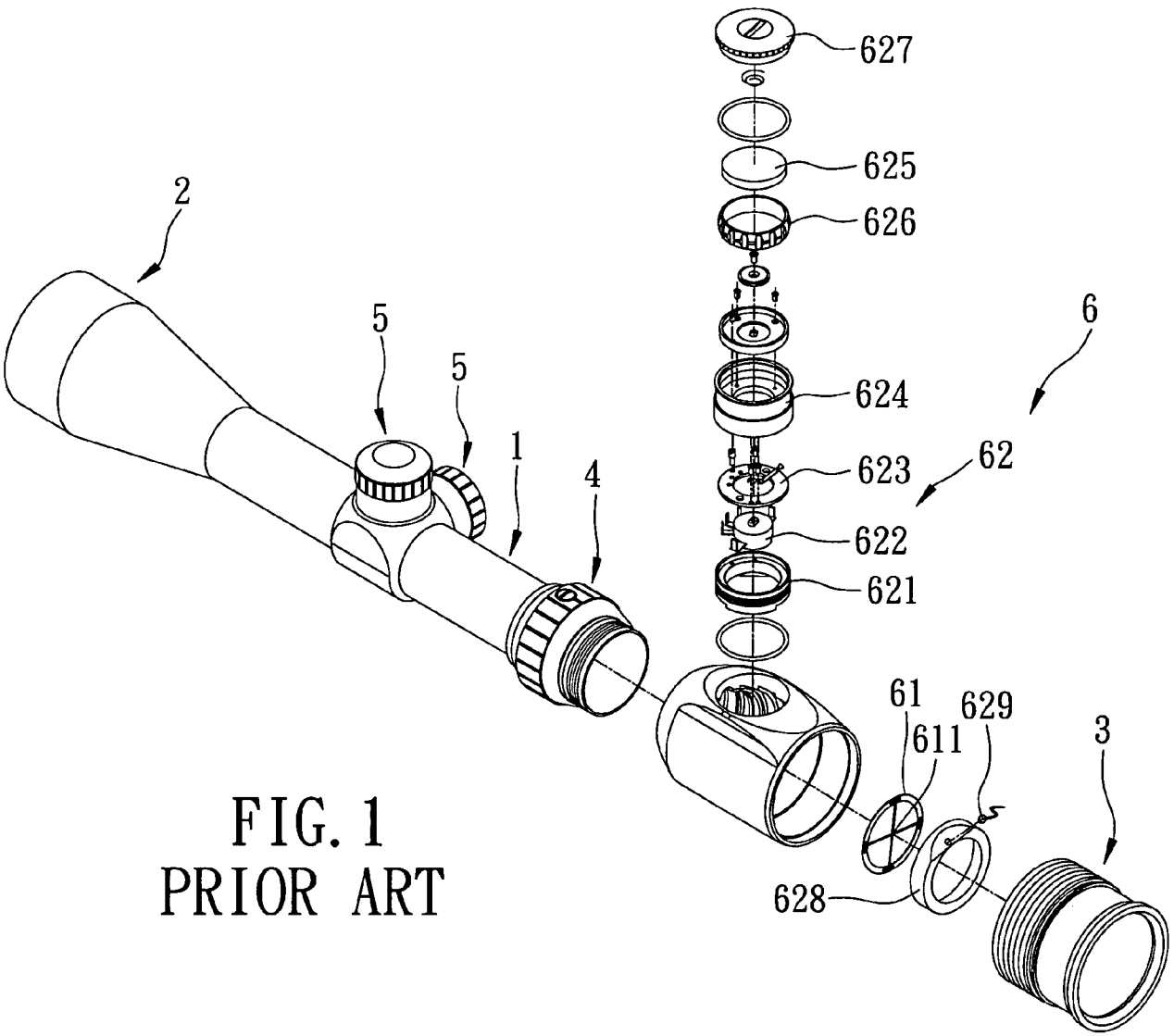
FIG. 1 PRIOR ART
FIG. 1 is a partly exploded perspective view of a conventional optical sight.
Figure 2:
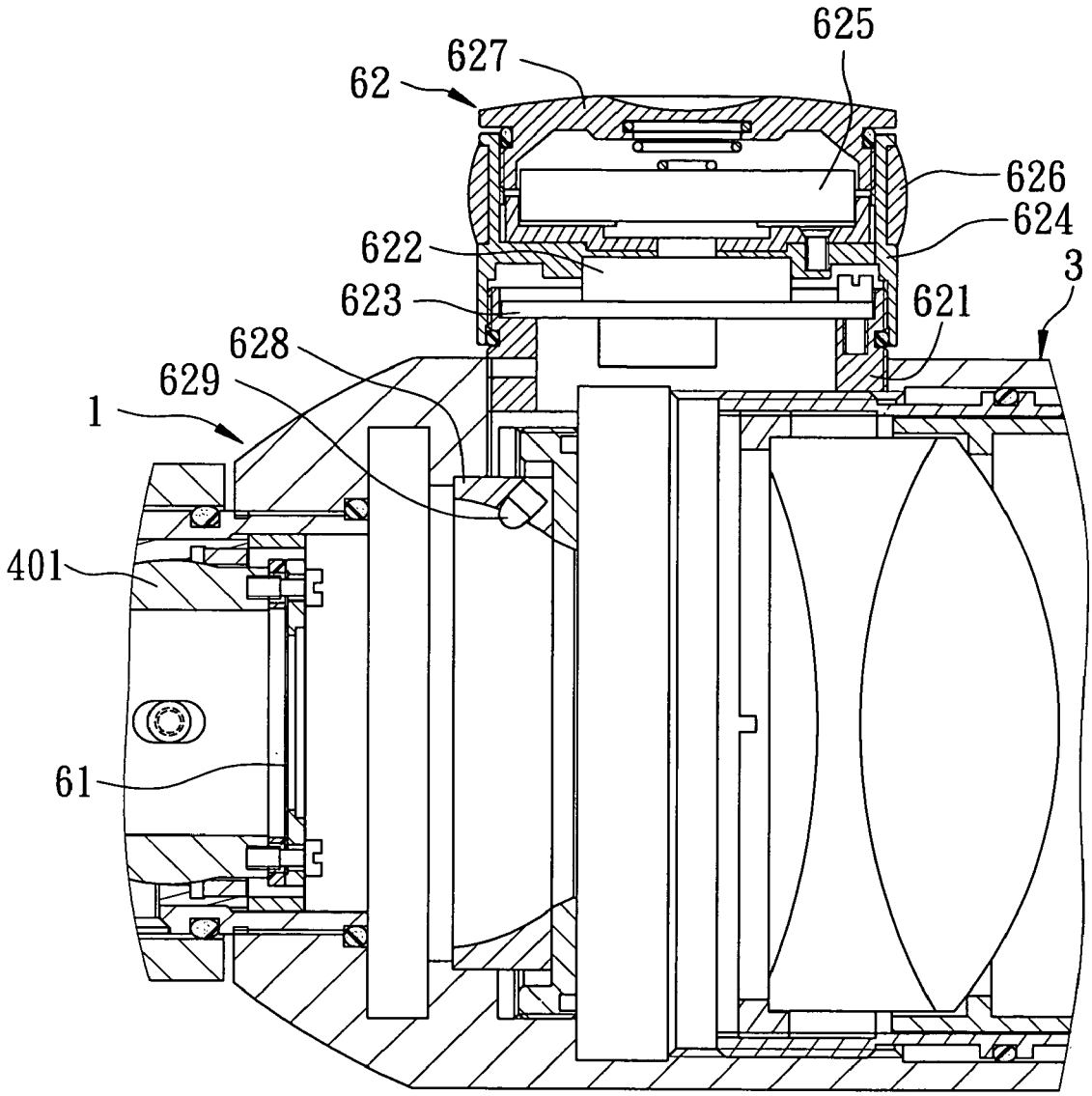
FIG. 2 PRIOR ART
FIG. 2 is a fragmentary sectional view of the optical sight of FIG. 1.

Before the present invention is described in greater detail, it should be noted that like elements are denoted by the same reference numerals throughout the disclosure.

Figure 3:
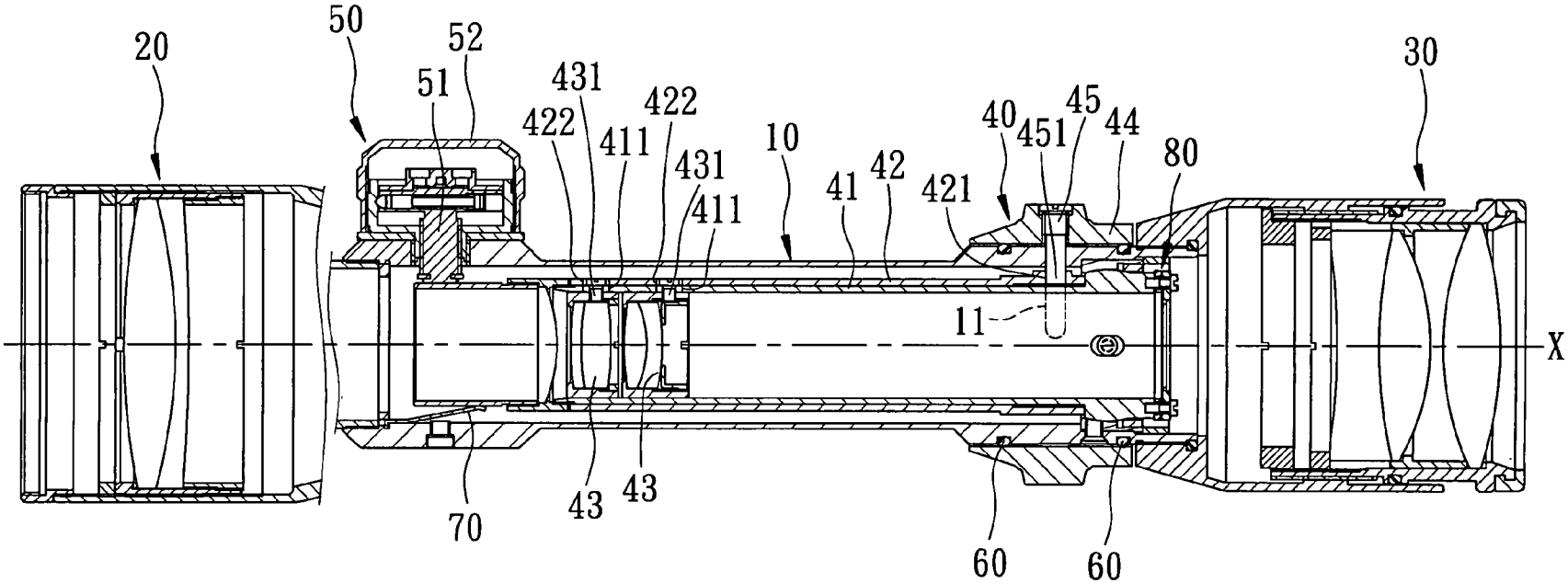
FIG. 3 is a fragmentary sectional view of an optical sight according to a first preferred embodiment of the present invention.
Figure 4:
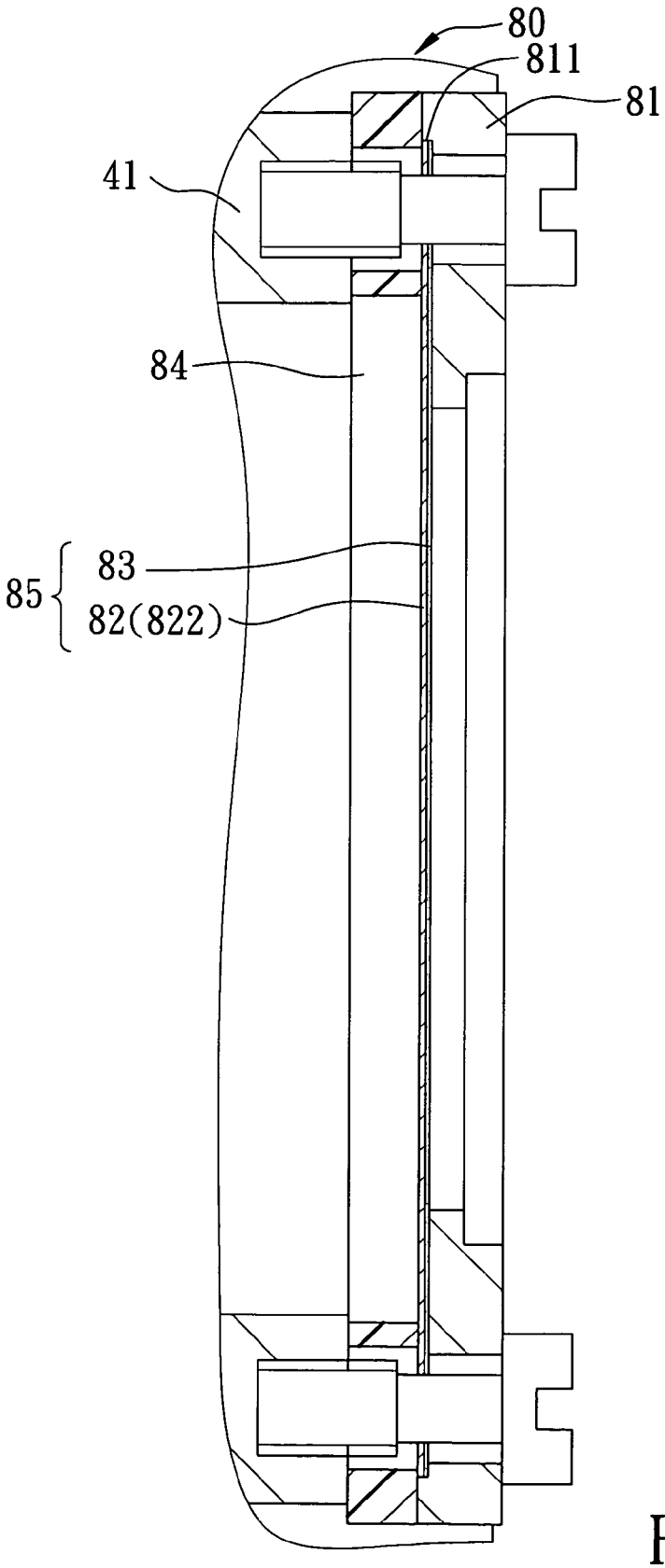
FIG. 4 is an enlarged fragmentary sectional view of the optical sight of FIG. 3, illustrating mounting of an aiming unit to a first inner barrel.
Figure 5:
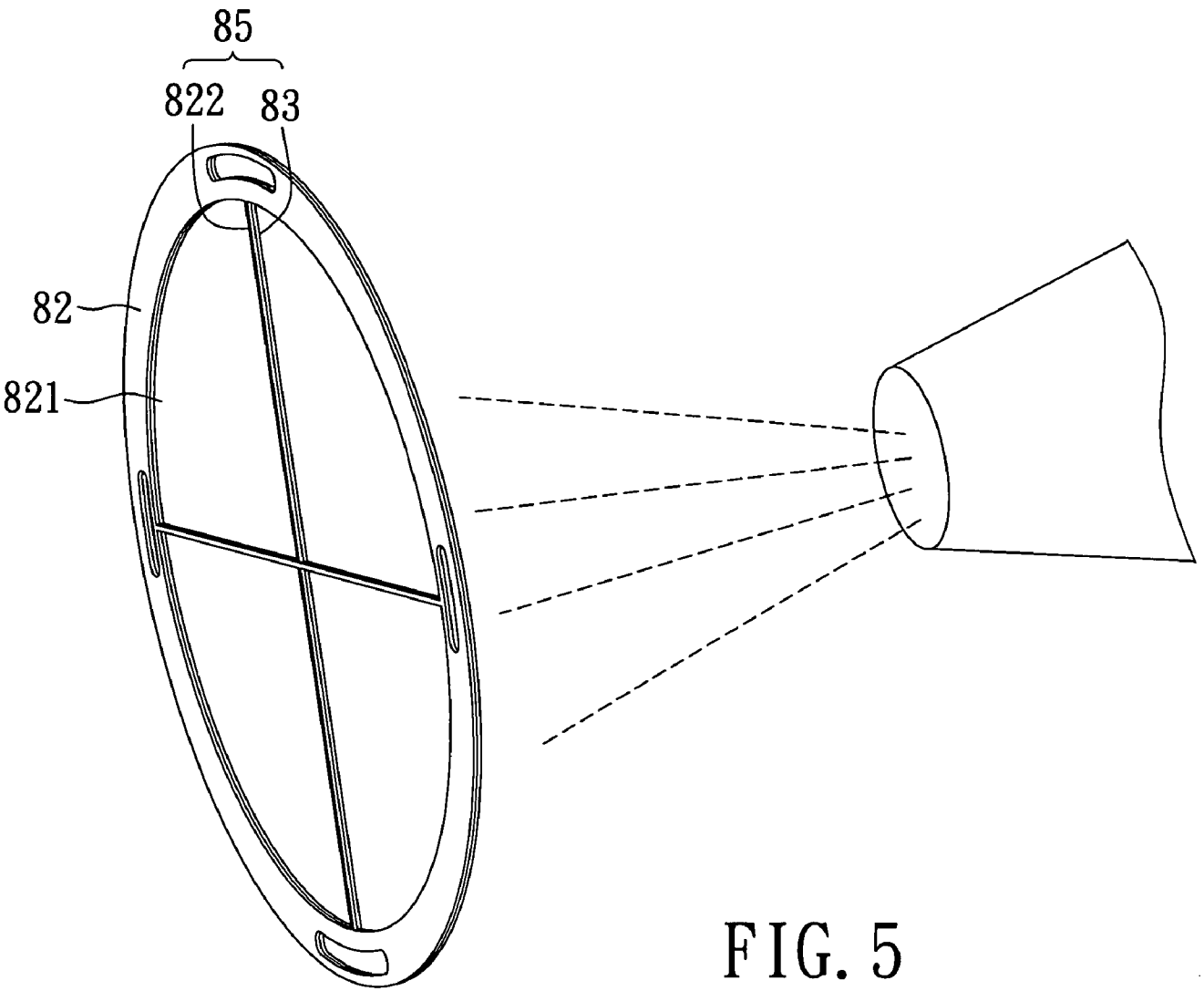
FIG. 5 is a perspective view of a plate member and an aim indicator of the first preferred embodiment.

Referring to FIGS. 3, 4, and 5, an optical sight according to a first preferred embodiment of the present invention includes an outer barrel 10, an objective lens unit 20, an ocular lens unit 30, a magnification unit 40, an adjustment unit 50, a pair of sealing rings 60, a restoring spring 70, and an aiming unit 80.

The outer barrel 10 is formed with a circumferentially extending slot 11. The outer barrel 10 has a longitudinal axis (X), which is indicated in FIG. 3, and first and second ends.

The objective lens unit 20 is mounted to the first end of the outer barrel 10.

The ocular lens unit 30 is mounted to the second end of the outer barrel 10.

The magnification unit 40 includes a first inner barrel 41 tiltably disposed in and extending between the first and second ends of the outer barrel 10, a second inner barrel 42 sleeved on the first inner barrel 41, a plurality of lens assemblies 43 movably disposed in the first inner barrel 41, an adjusting ring 44 sleeved on the outer barrel 10, and an adjusting pin 45 mounted to the adjusting ring 44.

The first inner barrel 41 has a rear end coupled pivotally to the outer barrel 10 in a known manner such that the first inner barrel 41 is tiltably disposed in the outer barrel 10.

The second inner barrel 42 is formed with a driven hole 421, which is registered with the circumferentially extending slot 11.

The adjusting pin 45 extends through and is movable along the slot 11, and includes a drive end 451 that is received in the driven hole 421.

The first inner barrel 41 is formed with a plurality of first cam slots 411 registered respectively with the lens assemblies 43. The second inner barrel 42 is formed with a plurality of second cam slots 422 registered respectively with the lens assemblies 43. Each of the lens assemblies 43 includes a guide pin 431 that passes through a corresponding one of the first cam slots 411 and that extends into a corresponding one of the second cam slots 422.

When adjusting magnification of the optical sight, the adjusting ring 44 is rotated to move the adjusting pin 45 along the slot 11, thereby driving the second inner barrel 42 to rotate relative to the first inner barrel 41. At this time, the guide pins 431 cooperate with the first and second cam slots 411, 422 to bring the lens assemblies 43 closer together or farther apart, thereby varying magnification of the optical sight.

The adjustment unit 50 is mounted on the outer barrel 10, and includes an adjusting element 51 with a lower end abutting against the first inner barrel 41, and a cover 52 surrounding the adjusting element 51. Upon removal of the cover 52, the adjusting element 51 may be manipulated to thereby vary the position of the first and second inner barrels 41, 42 in the outer barrel 10 relative to the longitudinal axis (X) of the outer barrel 10. Through provision of a second adjustment unit (not shown), the user is able to perform both elevation and windage adjustment.

The sealing rings 60 are spaced apart from each other, and are interposed between an outer barrel surface of the outer barrel 10 and an inner ring surface of the adjusting ring 44. The adjusting pin 45 is disposed between the sealing rings 60.

The restoring spring 70 is interposed between the outer barrel 10 and the first inner barrel 41. In this embodiment, the restoring spring 70 is disposed on a side of the first inner barrels 41 such that an urging force is provided to the first inner barrel 41 to abut against the adjustment unit 50.

The aiming unit 80 is mounted to the rear end of the first inner barrel 41 and is disposed between the objective lens unit 20 and the ocular lens unit 30. The aiming unit 80 includes aglow-in-the-dark aim indicator 85 that is self-illuminating. In the first preferred embodiment, the aiming unit 80 further includes a securing ring 81 fastened to the rear end of the first inner barrel 41 and formed with a channel 811, a plate member 82 secured in the channel 811 in the securing ring 81 and confronting the rear end of the first inner barrel 41, a photoluminescent layer 83 coated on the plate member 82 on a side of the same facing the ocular lens unit 30, and a cushion pad 84 interposed between the securing ring 81 and the rear end of the first inner barrel 41. The plate member 82 is formed with a plurality of angularly spaced-apart apertures 821 to thereby form a reticle 822 in the plate member 82. The reticle 822 and the photoluminescent layer 83 cooperate to form the aim indicator 85.

In this embodiment, the plate member 82 may be made of a nickel alloy. Furthermore, in this embodiment, a rare earth metal may be used as the active material of the photoluminescent layer 83, and the active material may be mixed with ink, paint, a coating material, etc. The resulting material may then be coated and dried on the plate member 82 to thereby form the photoluminescent layer 83. The photoluminescent layer 83 radiates visible light after being energized by natural or artificially generated light. Hence, when the external light is low (e.g., at night), the photoluminescent layer 83 may emit light after being energized to thereby allow the user to view the glow-in-the-dark aim indicator 85 when looking through the optical sight. The reticle 822 of the plate member 82 may be used in the normal manner in a brightly lit environment.

In the optical sight of the first preferred embodiment, through the photo luminescent layer 83 coated on the plate member 82, the aim indicator 85 is made self-illuminating when energized. Hence, it is unnecessary, as in the case of the prior art configuration shown in FIG. 1, to provide the additional structure of the lighting unit 62. This significantly reduces the overall costs and assembly time of the optical sight. Furthermore, a deterioration in the watertight and airtight capabilities of the optical sight that may be caused by the lighting unit 62 is prevented from occurring.

Figure 6:
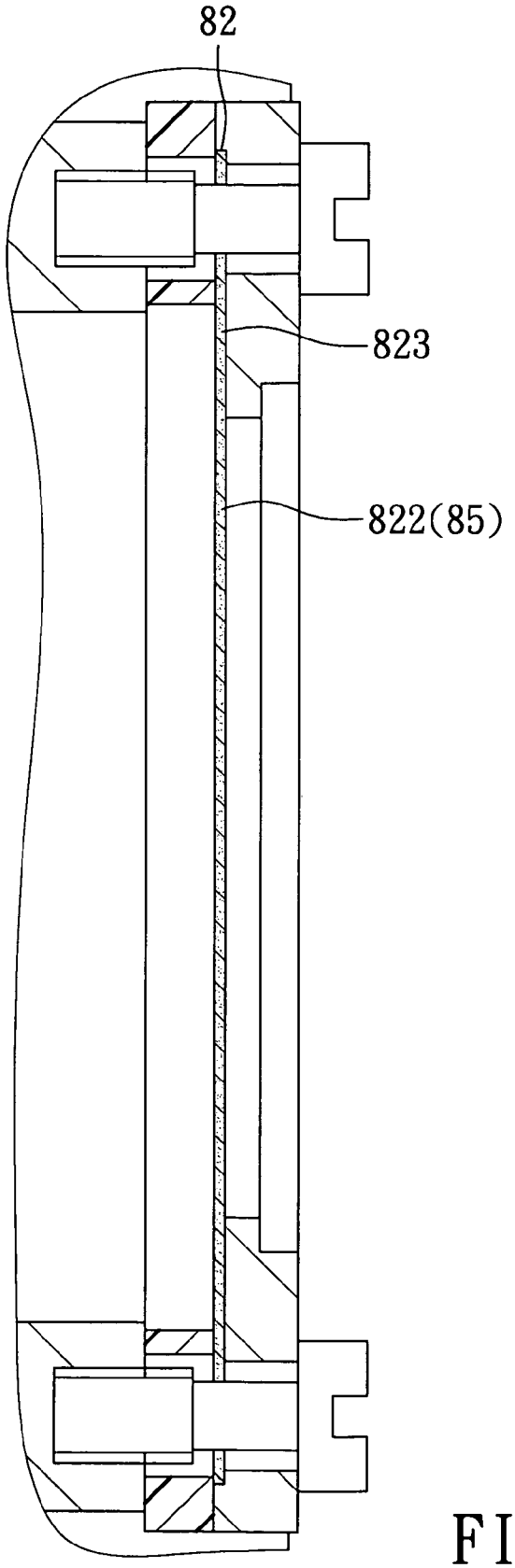
FIG. 6 is an enlarged fragmentary sectional view of an optical sight according to a second preferred embodiment of the present invention, illustrating mounting of an aiming unit to a first inner barrel.

An optical sight according to a second preferred embodiment of the present invention will now be described with reference to FIG. 6. The second preferred embodiment is substantially the same as the first preferred embodiment, but with the difference as outlined in the following.

The plate member 82 is made from a material containing a photoluminescent substance 823. As an example, the photoluminescent substance 823 is mixed in a nickel alloy such that the plate member 82 itself exhibits photoluminescent characteristics. In the second preferred embodiment, therefore, the aim indicator 85 is formed by the reticle 822 of the plate member 82. The second preferred embodiment has the same advantages as those of the first preferred embodiment.

Figure 7:
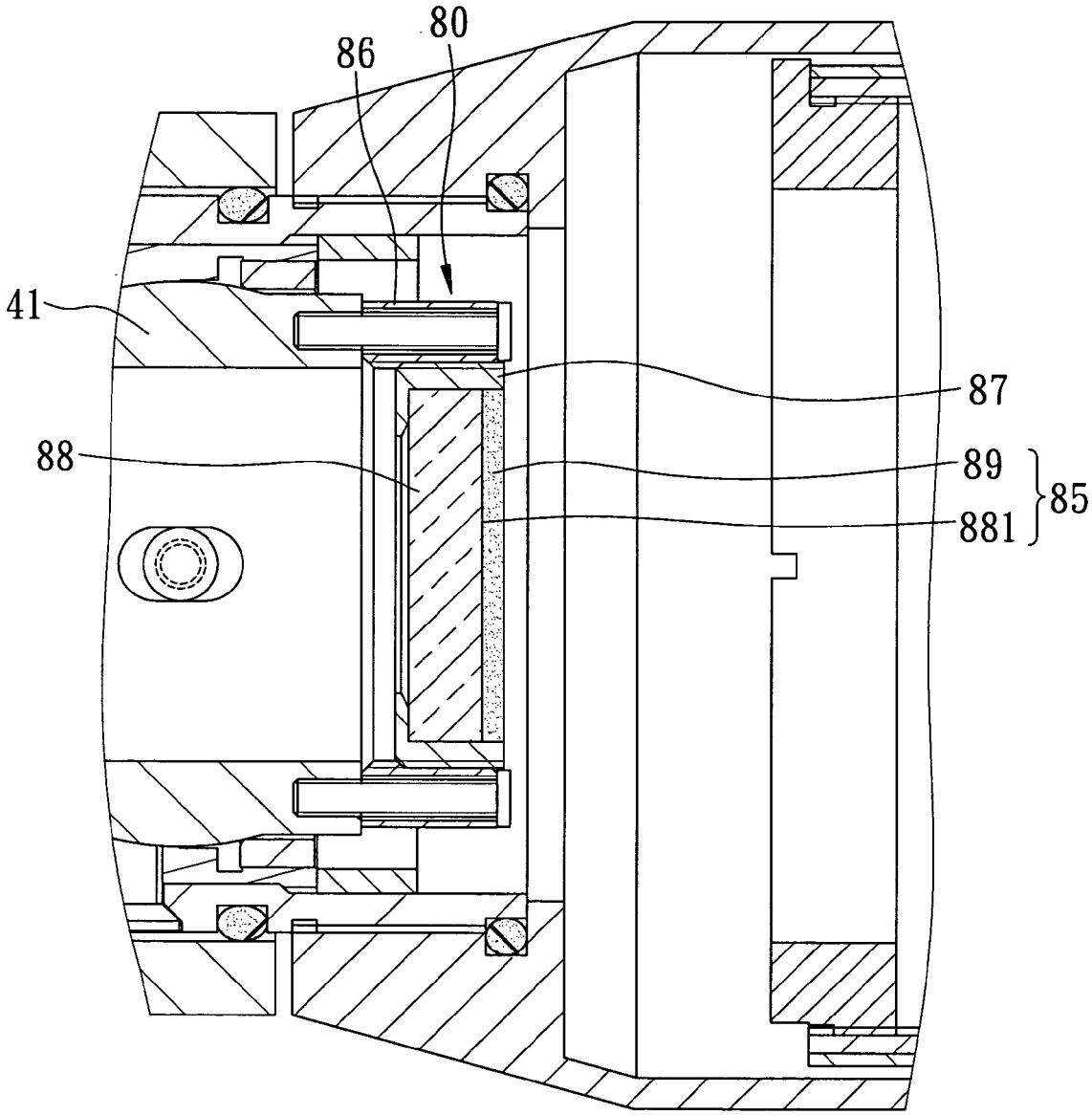
FIG. 7 is an enlarged fragmentary sectional view of an optical sight according to a third preferred embodiment of the present invention.
Figure 8:
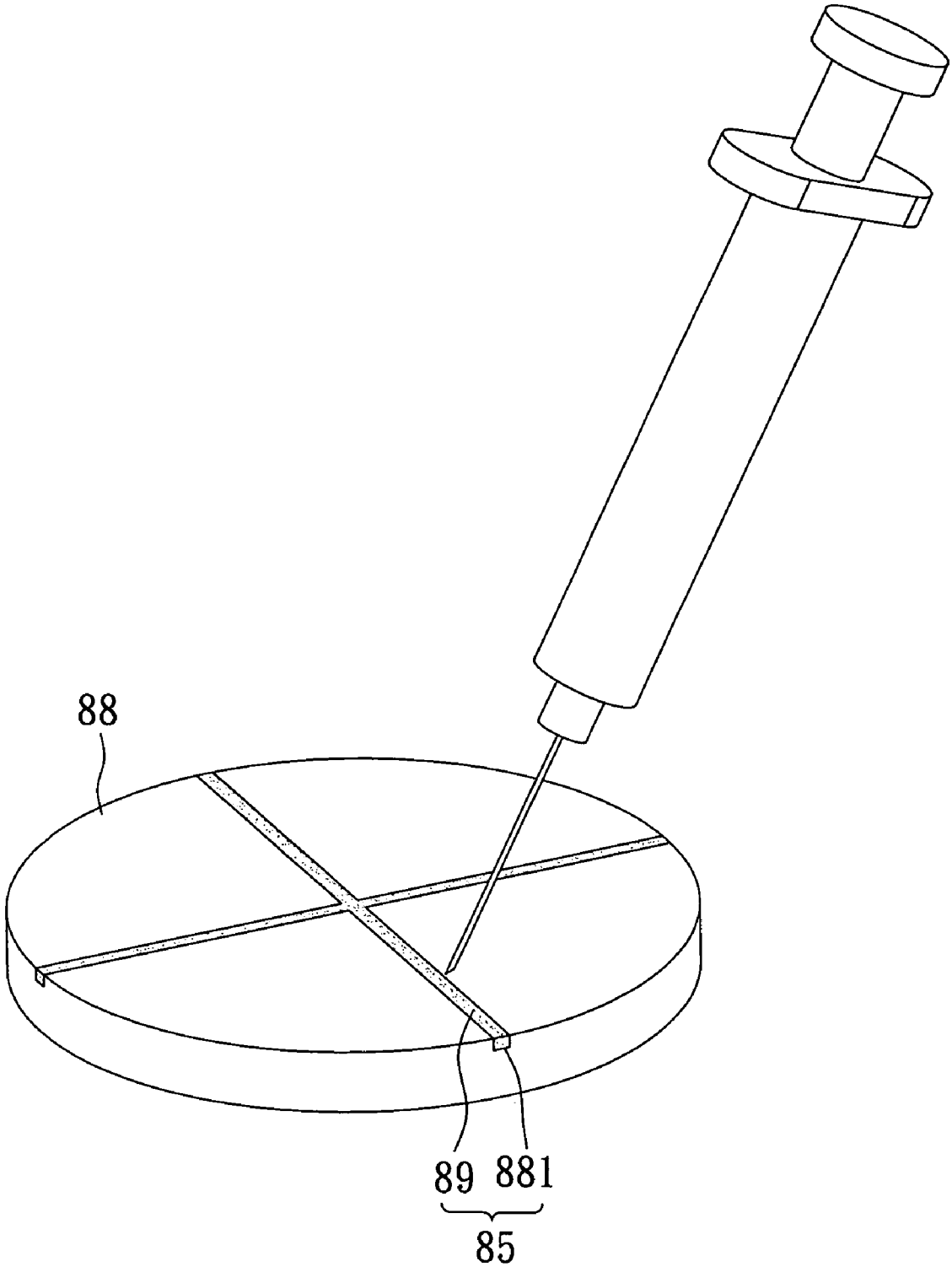
FIG. 8 is a perspective view of a plate member according to the third preferred embodiment, illustrating a process by which a photoluminescent material is filled in a cross-shaped groove in the plate member.

An optical sight according to a third preferred embodiment of the present invention will now be described with reference to FIGS. 7 and 8. The third preferred embodiment is substantially the same as the first preferred embodiment, but with the differences as outlined in the following.

The aiming unit 80 includes an outer ring 86 fastened to the rear end of the first inner barrel 41, a positioning ring 87 threadedly secured in the outer ring 86, a plate member 88 disposed in the positioning ring 87, and a photoluminescent material 89. The plate member 88 is made of a glass material, and is formed with a cross-shaped groove 881. The photoluminescent material 89 is filled in the cross-shaped groove 881. The cross-shaped groove 881 and the photoluminescent material 89 cooperate to form the aim indicator 85. The third preferred embodiment has the same advantages as those of the first preferred embodiment.

Figure 9:
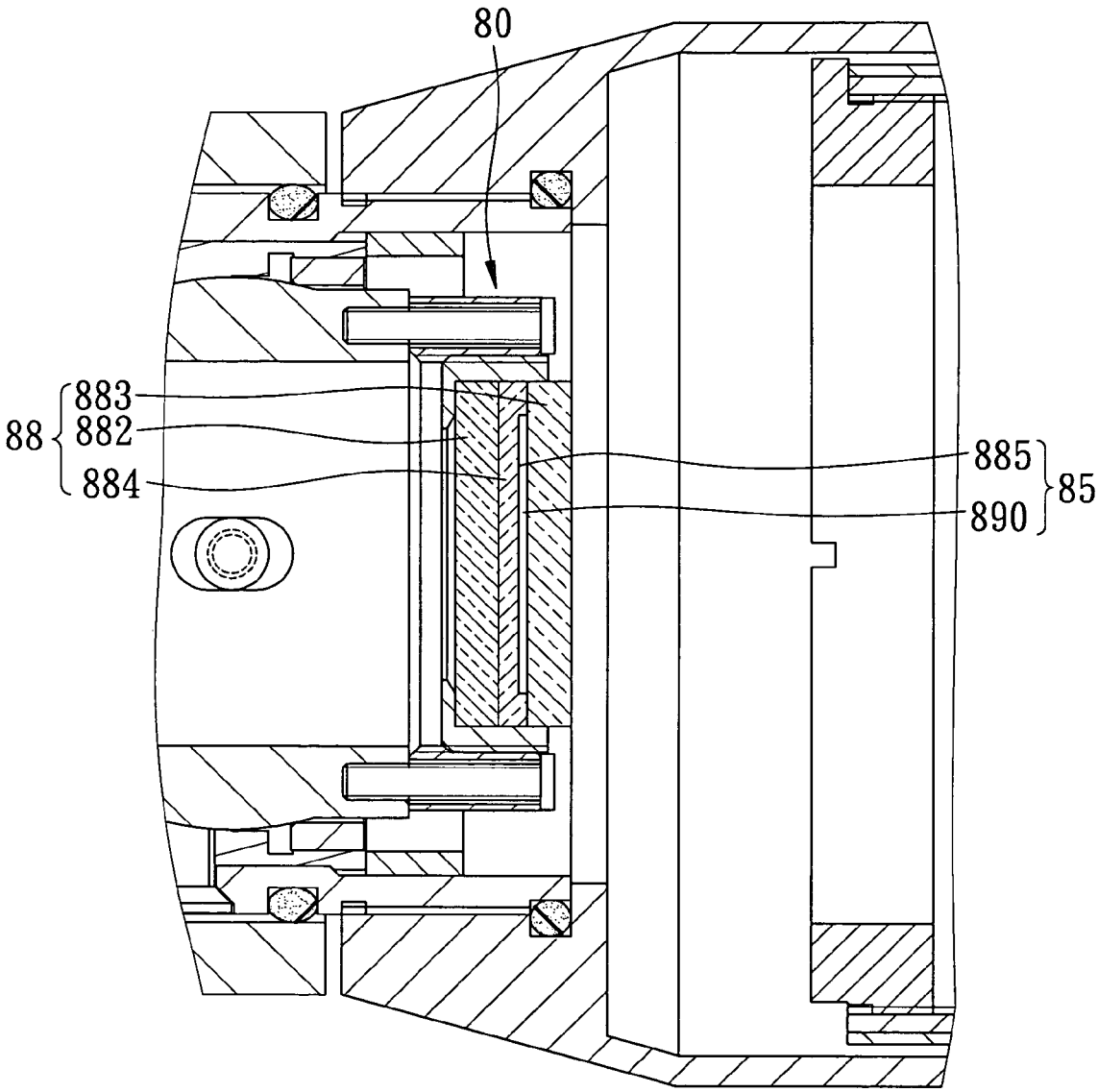
FIG. 9 is an enlarged fragmentary sectional view of an optical sight according to a fourth preferred embodiment of the present invention.
Figure 10:
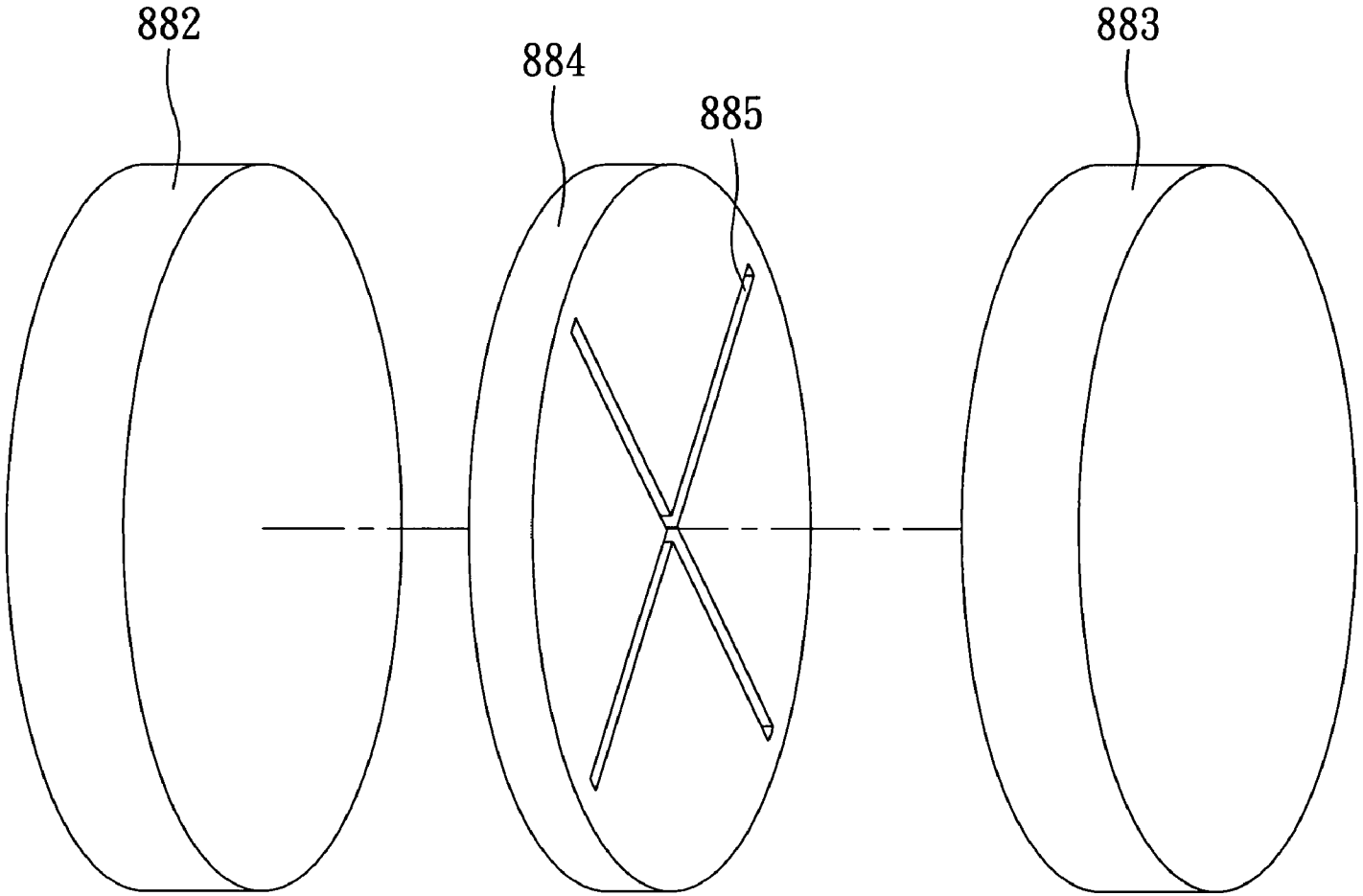
FIG. 10 is an exploded perspective view of a plate member of the fourth preferred embodiment.

An optical sight according to a fourth preferred embodiment of the present invention will now be described with reference to FIGS. 9 and 10. The fourth preferred embodiment is substantially the same as the third preferred embodiment, but with the differences as outlined in the following.

The aiming unit 80 includes a plate member 88, and a gaseous body 890 that exhibits photoluminescent characteristics. The plate member 88 includes a first glass plate 882, a second glass plate 883, and an intermediate glass plate 884 interposed between the first and second glass plates 882, 883. The intermediate glass plate 884 is formed with a cross-shaped cavity 885, and the gaseous body 890 is filled in the cross-shaped cavity 885. In this embodiment, the gaseous body 890 is tritium. The cross-shaped cavity 885 and the gaseous body 890 cooperate to form the aim indicator 85. The fourth preferred embodiment has the same advantages as those of the first preferred embodiment.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An optical sight, comprising:

an outer barrel having first and second ends;

an objective lens unit mounted to said first end of said outer barrel;

an ocular lens unit mounted to said second end of said outer barrel;

an aiming unit disposed in said outer barrel between said objective lens unit and said ocular lens unit, said aiming unit including a glow-in-the-dark aim indicator that is self-illuminating; and a magnification unit, said outer barrel being formed with a circumferentially extending slot, said magnification unit including a first inner barrel disposed in and extending between said first and second ends of said outer barrel, a second inner barrel sleeved on said first inner barrel, a plurality of lens assemblies movably disposed in said first inner barrel, an adjusting ring sleeved on said outer barrel, and an adjusting pin mounted to said adjusting ring, said second inner barrel being formed with a driven hole registered with said circumferentially extending slot, said adjusting pin extending through and being movable along said slot from said adjusting ring and including a drive end received in said driven hole, said first inner barrel having a rear end, said aiming unit being mounted to said rear end of said first inner barrel;

wherein said aiming unit further includes a securing ring fastened to said rear end of said first inner barrel, a plate member secured to said securing ring and confronting said rear end of said first inner barrel, and a cushion pad interposed between said securing ring and said rear end of said first inner barrel, said aim indicator being formed on said plate member.

2. The optical sight of claim 1, wherein said aiming unit further includes a photoluminescent layer coated on said plate member, said plate member being formed with a plurality angularly spaced-apart apertures to thereby form a reticle in said plate member, said reticle and said photoluminescent layer cooperating to form said aim indicator.

3. The optical sight of claim 1, wherein said plate member is made from a material containing a photoluminescent substance, said plate member being formed with a plurality angularly spaced-apart apertures to thereby form a reticle in said plate member, said aim indicator being formed by said reticle.

4. An optical sight, comprising:

an outer barrel having first and second ends;

an objective lens unit mounted to said first end of said outer barrel;

an ocular lens unit mounted to said second end of said outer barrel;

an aiming unit disposed in said outer barrel between said objective lens unit and said ocular lens unit, said aiming unit including a glow-in-the-dark aim indicator that is self-illuminating; and a magnification unit, said outer barrel being formed with a circumferentially extending slot, said magnification unit including a first inner barrel disposed in and extending between said first and second ends of said outer barrel, a second inner barrel sleeved on said first inner barrel, a plurality of lens assemblies movably disposed in said first inner barrel, an adjusting ring sleeved on said outer barrel, and an adjusting pin mounted to said adjusting ring, said second inner barrel being formed with a driven hole registered with said circumferentially extending slot, said adjusting pin extending through and being movable along said slot from said adjusting ring and including a drive end received in said driven hole, said first inner barrel having a rear end, said aiming unit being mounted to said rear end of said first inner barrel;

wherein said aiming unit further includes an outer ring fastened to said rear end of said first inner barrel, a positioning ring threadedly secured in said outer ring, and a plate member disposed in said positioning ring, said aim indicator being provided on said plate member.

5. The optical sight of claim 4, wherein said aiming unit further includes a photoluminescent material, said plate member being made of a glass material, said plate member being formed with a cross-shaped groove, said photoluminescent material being filled in said cross-shaped groove, said cross-shaped groove and said photoluminescent material cooperating to form said aim indicator.

6. The optical sight of claim 4, wherein said aiming unit further includes a gaseous body that exhibits photoluminescent characteristics, said plate member including a first glass plate, a second glass plate, and an intermediate glass plate interposed between said first and second glass plates, said intermediate glass plate being formed with a cross-shaped cavity, said gaseous body being filled in said cross-shaped cavity and cooperating with said cross-shaped cavity to form said aim indicator.

7. An optical sight, comprising:

an outer barrel having first and second ends;

an objective lens unit mounted to said first end of said outer barrel;

an ocular lens unit mounted to said second end of said outer barrel;

an aiming unit disposed in said outer barrel between said objective lens unit and said ocular lens unit, said aiming unit including a glow-in-the-dark aim indicator that is self-illuminating;

a magnification unit, said outer barrel being formed with a circumferentially extending slot, said magnification unit including a first inner barrel disposed in and extending between said first and second ends of said outer barrel, a second inner barrel sleeved on said first inner barrel, a plurality of lens assemblies movably disposed in said first inner barrel, an adjusting ring sleeved on said outer barrel, and an adjusting pin mounted to said adjusting ring, said second inner barrel being formed with a driven hole registered with said circumferentially extending slot, said adjusting pin extending through and being movable along said slot from said adjusting ring and including a drive end received in said driven hole, said first inner barrel having a rear end, said aiming unit being mounted to said rear end of said first inner barrel;

an adjustment unit mounted on said outer barrel, said outer barrel having a longitudinal axis, said adjustment unit being operable to adjust inclination of said first and second inner barrels in said outer barrel relative to said longitudinal axis of said outer barrel; and a pair of spaced-apart sealing rings interposed between said outer barrel and said adjusting ring, said adjusting pin being disposed between said sealing rings.

8. The optical sight of claim 7, wherein said aiming unit further includes a plate member, and a photoluminescent layer coated on said plate member, said plate member being formed with a plurality angularly spaced-apart apertures to thereby form a reticle in said plate member, said reticle and said photoluminescent layer cooperating to form said aim indicator.

9. The optical sight of claim 7, wherein said aiming unit further includes a plate member made from a material containing a photoluminescent substance, and formed with a plurality angularly spaced-apart apertures to thereby form a reticle in said plate member, said aim indicator being formed by said reticle.

10. The optical sight of claim 7, wherein said aiming unit further includes a glass plate member formed with a cross-shaped groove, and a photoluminescent material filled in said cross-shaped groove, said cross-shaped groove and said photoluminescent material cooperating to form said aim indicator.

11. The optical sight of claim 7, wherein said aiming unit further includes a first glass plate, a second glass plate, an intermediate glass plate interposed between said first and second glass plates, and a gaseous body that exhibits photoluminescent characteristics, said intermediate glass plate being formed with a cross-shaped cavity, said gaseous body being filled in said cross-shaped cavity and cooperating with said cross-shaped cavity to form said aim indicator.

12. The optical sight of claim 7, further comprising a restoring spring interposed between said outer barrel and said first inner barrel, said restoring spring being disposed on a side of said first inner barrel such that an urging force is provided to the first inner barrel to abut against the adjustment unit.

13. The optical sight of claim 12, wherein said first inner barrel is formed with a plurality of first cam slots registered respectively with said lens assemblies, and said second inner barrel is formed with a plurality of second cam slots registered respectively with said lens assemblies, each of said lens assemblies including a guide pin that passes through a corresponding one of said first cam slots and that extends into a corresponding one of said second cam slots.

* * * * *